United States Patent [19]

King

[11] 4,280,806

[45] Jul. 28, 1981

[54] PREVAPORIZING OIL BURNER AND METHOD

[76] Inventor: Paul C. King, Leavitt Rd., Pittsfield, N.H. 03263

[21] Appl. No.: 66,385

[22] Filed: Aug. 14, 1979

[51] Int. Cl.[3] ..... F23D 11/44

[52] U.S. Cl. ..... 431/208; 431/264; 431/352

[58] Field of Search ..... 431/195, 196, 200, 201, 431/208, 352, 353, 260, 262, 264

[56] References Cited

U.S. PATENT DOCUMENTS

| | | | |
|---|---|---|---|
| 1,247,792 | 11/1917 | Chadwick | 431/201 |
| 1,299,108 | 4/1919 | Best | 431/201 |
| 2,219,349 | 10/1940 | Turner | 431/201 |
| 2,964,101 | 12/1960 | Ayasse | 431/208 |
| 3,102,577 | 9/1963 | Dekker | 431/196 |

FOREIGN PATENT DOCUMENTS

| | | | |
|---|---|---|---|
| 1304307 | 1/1973 | United Kingdom | 431/208 |

*Primary Examiner*—Samuel Scott
*Assistant Examiner*—Lee E. Barrett
*Attorney, Agent, or Firm*—Thomas N. Tarrant

[57] ABSTRACT

An oil burner in which a liquid fuel oil is vaporized in a heated vaporizing chamber connected through an apertured partition to a multiple concentric shelled combustion chamber.

9 Claims, 3 Drawing Figures

PREVAPORIZING OIL BURNER AND METHOD

BACKGROUND OF THE INVENTION

1. Field of the Invention

The present invention relates to oil burners and particularly to those in which liquid fuel oil is heated to the vaporizing point before being introduced to a combustion chamber.

2. Description of the Prior Art

Heating efficiency from oil burners is reduced in efficiency due to three main causes. The first is poor atomization of the oil resulting in incomplete burning. The second, related to the first, is soot built up on heat exchangers, due to imcomplete burning, reducing heat exchanger efficiency and allowing large amounts of heat to pass out the flue. The third is addition of large amount of inert gases such as nitrogen through the air intake resulting in inert gaseous materials absorbing heat and carrying it up the flue. Most gun type atomizing oil burners leave a substantial residue of unburned hydrocarbons as evidenced by orange colored flame and smoke. Burners that come closer to the optimum blue flame are usually overaerated, resulting in losses from inert gases.

A number of burners have been designed with or without a pressure oil atomizing nozzle which heat the oil to its vaporizing point prior to combustion. Examples are found in U.S. Pat. Nos. 1,949,382; 1,968,360; 2,069,960; 2,458,630; 2,675,866 and 2,964,101.

In oil burners of this type, liquid fuel oil may be fed in at a relatively slow velocity onto a heated surface where it is vaporized. This is described for example in U.S. Pat. No. 2,964,101. Separation between the vaporization area and the combustion area has been provided in assorted ways along with varying complexity of means for introducing combustion air. Apparatus such as described in U.S. Pat. Nos. 1,968,360; 2,069,960 and 1,949,382 are believed to be oversimplified and probably inefficient in performance due to inadequate mixing of vaporized fuel and air in the combustion zone. The apparatus described in the other patents appear to be complex and expensive and costly in manufacture.

SUMMARY OF THE INVENTION

In accordance with the present invention, a vaporizing oil burner is provided in which a vaporizing chamber includes heating means for vaporizing liquid fuel oil and is connected by a perforated partition to a multiple concentric walled combustion chamber wherein gas and air is mixed a plurality of times for complete burning.

Further objections and features of the invention will become apparent upon reading the following description together with the drawing.

DESCRIPTION OF THE PREFERRED EMBODIMENT

Figure 1:
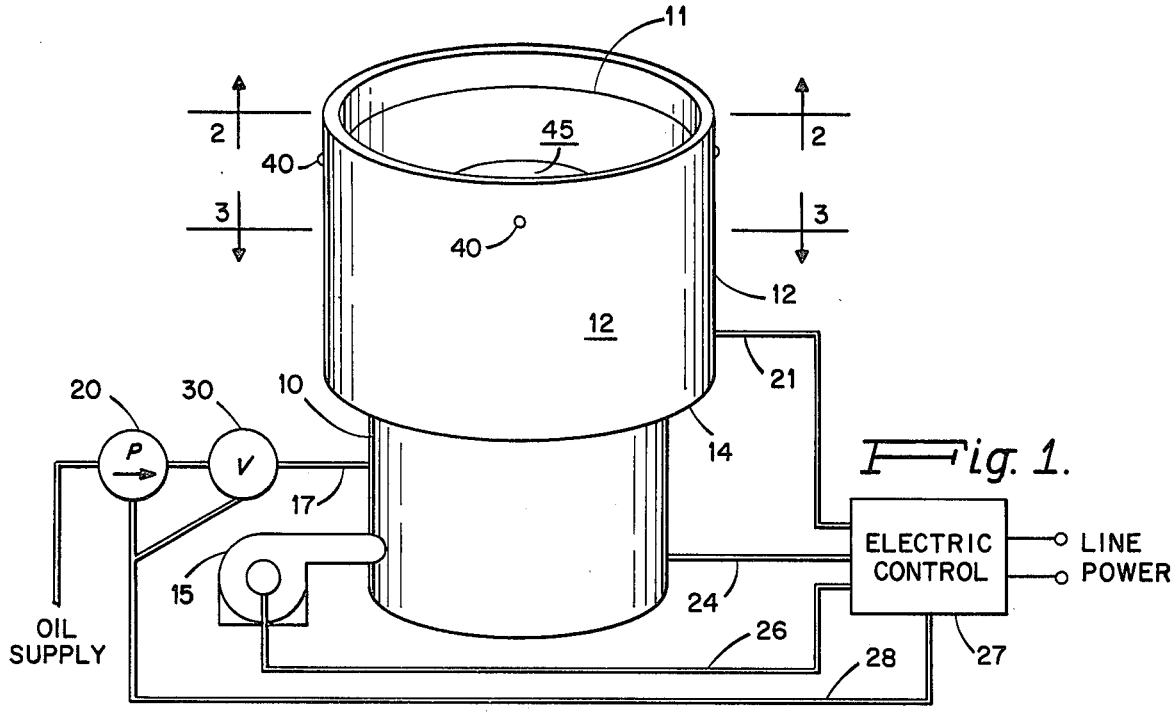
FIG. 1 is an illustration in perspective of an oil burner according to the invention.
Figure 2:
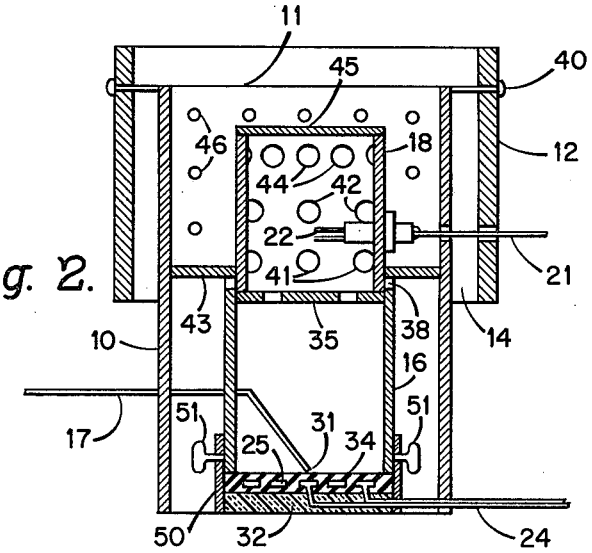
FIG. 2 is a sectional view taken along 2—2 of FIG. 1.

FIG. 1 depicts an oil burner according to the invention. It is to be understood that this is only the oil burner. It would normally be positioned inside of some type of furnace unit which would provide heat exchanging and flue provision. The oil burner of the invention has a main cylindrical shell 10. Shell 10 has an open top 11. Concentric with and outside of shell 10 is combustion air control shell 12. Shell 12 is suspended from shell 10 by studs extending from shell 10 and secured to shell 12. Shell 12 extends above top 11 of shell 10, but only partially along the length of shell 10 in the downward direction. Space 14 between shell 10 and shell 12 provides for the emission of ambient air for combustion. Small fan 15 connects through shell 10 into vaporizing chamber 16 (FIG. 2). Fan 15 and its connections are designed to provide sufficient air flow to move vaporized fuel out of chamber 16, but insufficient for supporting combustion.

Fuel oil line 17 connects through shell 10 into first combustion chamber 18 (FIG. 2). Fuel oil pump 20 may be provided to pump fuel oil from a fuel supply (not shown). Fuel may be also gravity fed. Pump 20 may be used to provide sufficient pressure to a nozzle for some amount of atomizing. Electric line 21 connected through shell 10 provides high voltage to ignition electrodes 22 (FIG. 2). Electric line 24 provies electric current for heat element 25 (FIG. 2) and electric line 26 is connected to fan 15. Electric lines 21, 24 and 26 are all connected to an electric control unit 27. A further electric line 28 from unit 27 connects to pump 20 and to valve 30 in oil line 17. Valve 30 is depicted as a solenoid valve and is preferably positioned as close as possible to the oil nozzle in vaporizing chamber 16. In FIG. 1, valve 30 is depicted immediately following pump 20 for ease of illustration. Valve 30 is desirable at or adjacent to oil nozzle 31 to prevent dripping when the apparatus is shut off. Electric control 27 provides the various electric control action in response to thermostat signals etc. to operate the oil burner.

FIG. 2 is a sectional view of FIG. 1 simplified by eliminating the accessories. In FIG. 2 it will be seen that vaporizing chamber 16 is made in the form of a cylindrical shell concentric within and spaced from main shell 10. Vaporizing chamber 16 is mounted on base 32 containing heating element 25. Oil nozzle 31 is positioned centrally in vaporizing chamber 16 to provide oil to surface 34 of heating element 25. While nozzle 31 is depicted as a single orifice nozzle, it may be a single or a plurality of orifices to provide fuel oil to heating element surface 34 either by slow drops flowing onto surface 34 or an atomized spray. Top 35 of vaporizing chamber 16 is a perforated plate acting as a dividing partition between vaporizing chamber 16 and combustion chamber 18. Fan 15 connects to vaporizing chamber 16 at aperture 36 near the bottom of vaporizing chamber 16 to provide sufficient gas motion to move vaporized fuel oil from vaporization chamber 16 into combustion chamber 18. Combustion chamber 18, as depicted, is a cylindrical shell slightly smaller in diameter than vaporization chamber 16. Open bottom end 37 of combustion chamber 18 rests upon partition 35 inside of raised rim 38 of vaporization chamber 16. Bolts or rivets 40 may be used to secure combustion chamber 18 to vaporization chamber 16. Combustion chamber 18 has three rings of perforations around its circumference. The ring of perforations 41 closest to vapor chamber 16 is for air intake only. The upper two rows 42 and 44 pass partially burned gases. Top 45 of combustion chamber 18 is solid. Main shell 10 extends from base 32 to above top 45 of combustion chamber 18. In the plane where air combustion chamber 18 connects with vaporization chamber 16, metal separation plate 43 extends from combustion chamber 18 to the wall of main shell 10 as additional separation between the vaporization and combustion chambers. Above the bottom of outer shell 12, main shell 10 carries a plurality of rows of perforations around its circumference. Outer shell 12 is spaced from main shell 10 permitting ambient air to pass through space 14 and through perforations 46 as main combustion air.

Figure 3:
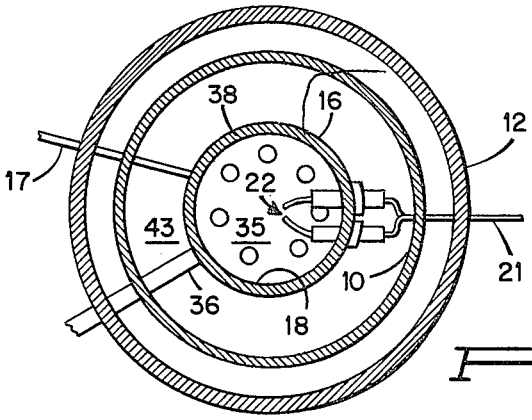
FIG. 3 is a sectional view taken along 3—3 of FIG. 1.

The arrangement of the various shells in the burner assembly are depicted in a plane sectional view in FIG. 3 for better understanding.

A specific burner unit has been assembled and operated in accordance with the following description:

Vaporization chamber 16 was made out of a metal cylinder 5 inches in diameter by 5 inches high with seven $\frac{1}{4}$ inch holes drilled in partition 35. Combustion chamber 18 was also constructed of a metal cylinder 5 inches high but $4\frac{7}{8}$ inches in diameter. Combustion chamber 18 was secured to rim 38 of vapor chamber 16 with allen screws. Rows of holes 41 and 42 in combustion chamber 18 were $\frac{3}{8}$ inch holes spaced 2 inches on center while row of holes 44 were $\frac{1}{2}$ inch spaced 1 inch on center. Holes 46 in main shell 10 were all $\frac{1}{4}$ inch holes perforated in three rows with $1\frac{1}{2}$ inches between rows and $1\frac{1}{2}$ inches on center between holes in any row. The upper-most row of perforations 46 was $\frac{1}{2}$ inch below top 11 of main shell 10. Main shell 10 extended from base 32 to 1 inch above combustion chamber 18.

Metal separation plate 43 was a round disc of metal fitting closely inside of shell 10 and resting on rim 38 of vapor chamber 16. Combustion chamber 18 fits through a central aperture in separation plate 43. A 450 watt hot plate was used as the heating element 25. Collar 50, integral with base 32, acted as a socket receiving the bottom end of vapor chamber 16. Thumbscrews 51 threaded into the walls of collar 50 were used to clamp chamber 16 to base 32. This arrangement facilitates replacement of base 32 in case the electrical heating element burns out. A one eighth inch line was used for oil line 17 terminating in contact with the hot plate with just the open end of the line. Line 17 was connected to an oil tank for gravity feed and a valve in the line was adjusted to provide slow drops of oil on to the hot plate. A small fan in a blower type housing as depicted at 15 was connected by an adapter plate to $\frac{3}{8}$ inch tubing which was connected into vapor chamber 16 about one inch above heating element 25. Conventional ignition electrodes as used in domestic gun type oil burners were utilized for electrodes 22 and were connected to a conventional ignition transformer. Air control shell 12 was mounted on studs 40 projecting from the top of main shell 10. Studs 40 were metal pins welded at their inner ends to shell 10 and passing through drilled holes in shell 12. Shell 10 was 8 inches in diameter and shell 12 was 10 inches in diameter thus a separation existed between chamber 18 and shell 10 of $1\frac{1}{2}$ inches and a separation existed between shell 10 and shell 12 of 1 inch. Shell 12 extended 1 inch above shell 10.

In operation heating element 25 was energized until it came up to temperature than the valve on oil line 17 was opened enough to provide slow drops of oil. A few seconds later electrodes 22 were energized to start combustion. Jets of blue flame were observed at perforations 42, 44 and 46. After 1 minute of operation, heating element 25 was turned off without affecting the operation of the burner. Heat radiating and conducting to the vaporizing chamber from the burner flame being enough to maintain vaporization.

It is contemplated that with the burner positioned in the base of a heating exchanging apparatus, such as an oil furnace, that combustion air flow to space 14 would be provided by a vent in the furnace casing below the level of chamber 18. With the oil burner of the present invention disposed in heat exchanging apparatus, conventional flue passages to such apparatus would carry off the flue gases from the burner. The flue system would be similar to that used by gas furnaces so that minimal draft would be used.

While the invention has been described with relation to a specific embodiment, it is to be understood that the specific dimensions and proportions are not critical within reasonable limits, nor is the arrangement of accessories and controls significant. Other arrangements can be used taking into consideration reliability and safety aspects. Thus it is intended to cover the invention as set forth within the scope of the appended claims.

I claim:

1. An oil burner which prevaporizes liquid fuel oil by heat in a vapor chamber prior to combustion in a separate combustion chamber comprising:

(a) a vapor chamber;

(b) means to introduce liquid fuel oil into said vapor chamber;

(c) heating means in said vapor chamber operable at a temperature sufficient to vaporize said liquid fuel oil;

(d) a first combustion chamber connected to said vapor chamber and divided from said vapor chamber by a perforated partition;

(e) fan means connected to said vapor chamber at an aperture near the bottom of said vapor chamber for moving vapor formed in said vapor chamber to said first combustion chamber;

(f) ignition means in said first combustion chamber for igniting vaporized fuel oil;

(g) at least two series of perforations in said first combustion chamber with a first series of perforations for introducing air and a second series of perforations for passing flames and flue gases;

(h) aperforated shell spaced around said first combustion chamber forming a second combustion chamber therebetween, said perforated shell being open at one end for passage of flue gases;

(i) a solid shell spaced around said perforated shell, said solid shell open at a first end for entry of combustion air and at a second end for exhausting heated flue gases.

2. An oil burner according to claim 1 wherein said vapor chamber and said first combustion chamber are cylindrical chambers on a common axis.

3. An oil burner according to claim 2 wherein said vapor chamber and said first combustion chamber are substantially the same length and substantially the same diameter.

4. An oil burner according to claim 3 wherein said first combustion chamber has a first end adjacent said perforated partition and a second closed end, said first series of perforations being proximate said first end, and said second series of perforations being proximate said second closed end.

5. An oil burner according to claim 4 wherein said perforated shell is a cylinder concentric about said axis and extending at least from the plane of said perforated partition a distance beyond said closed end to terminate at an open end, the perforations in said perforated shell all being located between said open end and a plane between said first series of perforations and said second series of perforations.

6. An oil burner according to claim 5 wherein space between said perforated shell and said first combustion chamber is closed off substantially at the plane where said first combustion chamber is connected to said vapor chamber.

7. An oil burner according to claim 1 wherein said vapor chamber, said first combustion chamber, said perforated shell and said solid shell are all formed of cylinders assembled concentrically on a central axis with each cylinder extending beyond the respective previous cylinder.

8. An oil burner according to claim 7 wherein said first combustion chamber has a first open end adjacent said perforated partition and a second closed end and said at least two series of perforations is three series of perforations in which the first series is proximate said open end, said second series is proximate said closed end and said third series is midway between said first series and said second series.

9. An oil burner according to claim 8 wherein said second series of perforations has substantially greater perforation area than either of said first series and said third series of perforations.

* * * * *